United States Patent [19]

Nickel et al.

[11] 4,405,328

[45] Sep. 20, 1983

[54] PREPARATION FOR SHRINKPROOFING WOOL

[75] Inventors: Friedhelm Nickel; Götz Koerner; Günter Schmidt, all of Essen; Hans Rott, Gladbeck, all of Fed. Rep. of Germany

[73] Assignee: Th. Goldschmidt AG, Essen, Fed. Rep. of Germany

[21] Appl. No.: 296,569

[22] Filed: Aug. 26, 1981

[30] Foreign Application Priority Data

Sep. 12, 1980 [DE] Fed. Rep. of Germany ..... 3034380

[51] Int. Cl.[3] ..... D06M 13/10

[52] U.S. Cl. ..... 8/128 A; 8/128 R; 252/8.6; 524/588; 427/387

[58] Field of Search ..... 8/128 A; 252/8.6; 524/588; 427/387

[56] References Cited

U.S. PATENT DOCUMENTS

| | | | |
|---|---|---|---|
| 4,182,682 | 1/1980 | Koerner et al. | 252/8.6 |
| 4,248,590 | 2/1981 | Koerner et al. | 8/128 A |
| 4,283,191 | 8/1981 | Koerner et al. | 8/128 A |
| 4,311,760 | 1/1982 | Kalinowski et al. | 427/387 |

*Primary Examiner*—Maria Parrish Tungol

*Attorney, Agent, or Firm*—Toren, McGeady & Stanger

[57] ABSTRACT

The invention relates to an aqueous preparation for shrinkproofing wool, which contains, as active ingredient, organopolysiloxanes of a particular structure with mercaptoalkyl or mercaptoaryl radicals and hydrogen atoms. The preparation is storage-stable and causes no yellowing in naturally colored or white wool. The hand of the wool is not disadvantageously affected.

15 Claims, No Drawings

PREPARATION FOR SHRINKPROOFING WOOL

BACKGROUND OF THE INVENTION

1. Field of the Invention

The invention relates to a preparation for shrinkproofing wool.

2. Description of the Prior Art

It is well known that wool, in the untreated state, shrinks and felts on being laundered in an aqueous liquor. In order to counteract this shrinking and felting, chemical treatments have already been recommended in which the structure of the wool is changed or in which finishes are used which contain resin which deposits on the surface of the wool fibers, enveloping these. By both processes, however, products are obtained whose so-called hand is regarded as unpleasant by the consumer.

It has also already been recommended that the shrinkage of wool of laundering be reduced by treatment with organosilicon compounds. Such compounds are described in British Pat. Nos. 594,901, 613,267, and 629,329. In accordance with these processes, the wool is treated with certain silanes.

A process for the prevention of shrinkage of wool is described in British Pat. No. 746,307, in which the wool fibers are finished with particular organopolysiloxanes. Admittedly, a certain degree of shrinkproofness is achieved by this process, however, this effect is not washfast.

German Offenlegungsschrift No. 1,769,249 discloses a process for the treatment of fibrous material, for example, of wool, in which organosiloxanes which contain mercaptopropyl groups are used in the form of an emulsion. With these compounds, however, it is merely possible to achieve a soil repellent effect. The compounds are not suitable for making wool shrink-resistant.

German Offenlegungsschrift No. 2,912,431 discloses an organopolysiloxane latex which consists of the product of the polymerization of a cyclic organopolysiloxane of the general formula

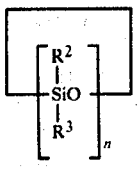

in which $R^2$ and $R^3$ which may be the same or which may differ from each other, represent substituted or unsubstituted monofunctional hydrocarbon radicals with 1 to 10 carbon atoms and n has an average value of 3 to 6, in the presence of (A) an organofunctional trialkoxysilane of the general formula $$(R'O)_3SiRX,$$

in which

R' represents a monofunctional hydrocarbon radical with less than 7 carbon atoms or a group of the formula $$-CH_2OC_2H_5 \text{ or } -CH_2CH_2OCH_3,$$

R represents a bifunctional hydrocarbon group with not more than 12 carbon atoms, and X represents an organofunctional radical of the formula $$-NH_2, -CH_2CH_2NH_2 \text{ or } -(CH_2)_4NH_2$$

or radicals with the name of N-cyclohexylamino, N-phenylamino, N-aminoethylamino, N,N-dimethylaminoglycidyl, 3,4-epoxycyclohexyl, mercapto or methacrylo, (B) a surface active material, and (C) water.

With such preparations, is is admittedly possible to influence the hand and, within certain limits, the wettability and the water repellency of the wool. However, as will also be shown in a comparison example, it is not possible to finish the wool with these latexes so that it will not felt.

German Offenlegungsschrift No. 2,725,714 describes a siloxane-in-water emulsion which contains (A) a polydiorganosiloxane, (B) an organosiloxane with at least 3 silicon bonded hydrogen atoms and alkyl radicals with fewer than 19 carbon atoms as organic substituents, and (C) one or more cationic and/or nonionic emulsifiers.

It is characterized by the fact that the polydiorganosiloxane (A) has a molecular weight of at least 2,500 and terminal OX radicals, X being a hydrogen atom, an alkyl radical with 1 to 15 carbon atoms or an alkoxyalkyl radical with 3 to 15 carbon atoms. At least two of the silicon bonded substituents of the polydiorganosiloxane are monofunctional radicals of carbon, hydrogen, nitrogen, and optionally, oxygen, which contain at least two amino groups and are linked through a silicon-carbon bond to silicon. Also, at least 50% of all substituents of the polydiorganosiloxane are methyl groups and the otherwise present substituents are monofunctional hydrocarbon radicals with 2 to 20 carbon atoms, and the emulsion additionally contains (D) magnesium sulfate and/or sodium sulfate.

This emulsion is intended to be useable for the treatment of goods made of keratinous fibers, for example, for the treatment of sweaters. It is a disadvantage of these emulsions and also of the diluted liquors prepared from them that the splitting off of hydrogen from the silyl hydrogen containing siloxanes is accelerated by the amino groups of the amino alkyl modified siloxane diols. This impairs and shortens the stability of the emulsions and of the diluted liquors. At the same time, the effectiveness of the liquor is reduced, as will also be shown by a comparison example below. Moreover, it turns out that especially bright and naturally colored wool yellows when treated with these products.

Accordingly, it was not possible to shrinkproof wool perfectly and entirely satisfactorily with the preparations of the state of the art.

SUMMARY OF THE INVENTION

We have discovered a preparation for shrinkproofing wool which is storage stable, causes no yellowing in naturally colored or white wool, and leaves the treated wool in its original condition even after multiple launderings. At the same time, the hand of the treated wool or of knitted and woven fabrics, prepared from the wool, is not detrimentally affected.

The preparation of the present invention consists of (a) 1 to 50 weight percent of organopolysiloxanes, which either consist, in the middle part of the molecule, of (aa) 80 to 99.8 weight percent of units of the formula $$R_n^1SiO_{\frac{4-n}{2}} \quad \text{and}$$

(ab) 0.2 to 20 weight percent of units of the formula $$R_m^2SiO_{\frac{4-m}{2}}$$

in the form of copolymers, or in which the siloxanes are present in the form of mixtures in each case of siloxanes with units of the formula (aa) and siloxanes with units of the formual (ab), in which the $R^1$ radicals consist of mercaptoalkyl or mercaptoaryl radicals to the extent of 0.03 to 3 mole percent and the $R^2$ radicals of hydrogen atoms to the extent of 5 to 50 mole percent, the remaining portion of $R^1$ and $R^2$ radicals being methyl radicals, of which, however, up to 10 mole percent may be replaced by longer-chain alkyl, aryl or hydrogen radicals, n has a value of 1.8 to 2.0 and m a valued of 2.0 to 2.5, and (b) 50 to 99 weight percent of water.

Optionally, conventional emulsifiers and/or organic solvents and the usual additives may be added.

The simultaneous presence of siloxanes with mercaptohydrocarbon radicals and of silyl hydrogen atoms is an essential characteristic of the inventive process. It is at the same time possible to use either copolymers, in which the (aa) and (ab) units are present next to each other in the central part of the molecule, or mixtures of siloxanes in which the one component of the siloxane mixture contains (aa) units and the other component of the siloxane mixture (ab) units.

DESCRIPTION OF THE PREFERRED EMBODIMENT

Especially preferred are preparations which contain organopolysiloxanes, in which the $R^1$ radicals consist of mercaptoalkyl or mercaptoaryl radicals to the extent of 0.1 to 0.5 mole percent, the remaining portion of $R^1$ radicals being methyl radicals.

Examples of mercaptoalkyl or mercaptoaryl radicals linked to the polysiloxane backbone are the mercaptomethyl, 2-mercaptoethyl, 3-mercaptopropyl, 3-mercaptoisobutyl or mercaptophenyl radical. The 3-mercaptopropyl radical is especially preferred.

A preferred inventive preparation is characterized by the fact that it contains organopolysiloxanes in which the $R^2$ radicals consist of hydrogen atoms to the extent of 36 to 48 mole percent, m has a value of 2.2 to 2.03 and the remaining portion of $R^2$ radicals are methyl radicals.

Especially preferred is a preparation which contains as siloxanes of the structure unit (ab), those of the formula

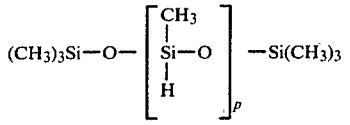

in which p has a value of 3 to 50.

In particular, those siloxanes with (aa) units are preferred, in which n has a value of 1.990 to 1.998.

To the extent that they are not mercaptoalkyl or mercaptoaryl radicals or hydrogen atoms, the $R^1$ and $R^2$ radicals are methyl radicals. It is, however, permissible that up to 10% are replaced by longer-chain alkyl or aryl radicals. Examples of such alkyl or aryl radicals are the ethyl, propyl, dodecyl or phenyl radicals.

The preparation of copolymers with (aa) and (ab) units or of polysiloxanes which contain either (aa) or (ab) units is known from the state of the art. Organopolysiloxane units of formula (aa) may be prepared by first synthesizing polydimethylsiloxane diols having a viscosity of about 100 to 100,000 $mm^2$/sec measured at 20° C. by emulsion polymerization, and especially by the cationic emulsion polymerization of low molecular weight cyclic polydimethylsiloxanes. These polydimethylsiloxane diols are then copolymerized with the desired amount of 3-mercaptohydrocarbon trialkoxysilane. Especially preferred, therefore, are preparations with the characteristics that they contain, as organopolysiloxane of the (aa) structure unit, those in which the mercaptoalkyl or mercaptoaryl radicals are linked terminally.

The preparation of silyl hydrogen-containing siloxanes is well known to those skilled in the art and can be accomplished, for example, by hydrolysis and condensation of the corresponding silanes.

The inventive preparation may be present in the form of an emulsion. It may, however, be used in the form of a solution in organic solvents.

The production of the inventive preparation in emulsion form can be accomplished in a known manner by emulsifying with the help of emulsifiers, for example, nonionic emulsifiers. These are obtainable by the addition of ethylene oxide and/or propylene oxide to compounds with an acidic hydrogen, for example, fatty alcohols, such as, lauryl alcohol or stearyl alcohol. Especially preferred are cationic emulsifiers, such as, for example, quaternary ammonium compounds, which have at least one longer-chain, hydrophobing radical attached to the nitrogen. For example, trimethyl lauryl ammonium chloride is a suitable emulsifier.

If the inventive preparation is to be used in the form of an organic solution, chlorinated hydrocarbons, such as, for example, 1,1,1-trichloroethane is preferred as solvent.

The preparation may contain the usual additives, such as, for example, optical brighteners, flame retardants, materials which affect the hand of textiles, fixatives, and fragrant substances.

Organopolysiloxane copolymers, which are suitable for the inventive preparations and contain units of formula (aa) and (ab), may, for example, have the following structures

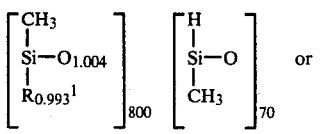

or

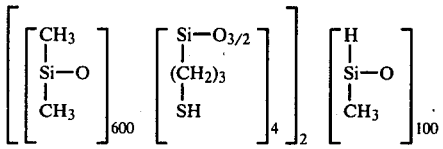

in which $R^1$ consists of mercaptopropyl radicals to the extent of 0.33 mole percent, the remaining $R^1$ radicals being methyl radicals.

Organopolysiloxanes, which are used in the form of their mixture may have the following structures:

1. Siloxanes with (aa) units

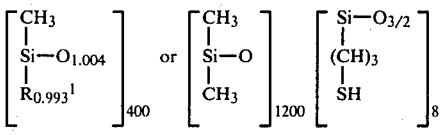

in which $R^1$ is as defined above.

2. Siloxane with (ab) units.

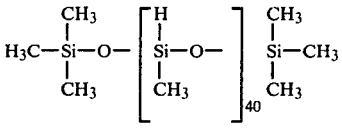

The following examples show the production and formulation of suitable preparations as well as the properties of knitted fabrics treated with the inventive preparations, partly in comparison with known preparations.

EXAMPLE 1

To a reaction vessel are added 470 g of water, 3.3 g of didecyldimethylammonium chloride, 1.7 g dioctadecyldimethylammonium chloride, 3.5 g of a betaine of the formula

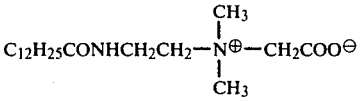

and 10 g of a 1-molar potassium hydroxide solution and heated to 95° C. with stirring. Octamethylcyclotetrasiloxane (167 g, 0.56 moles) is added from a dropping funnel over a period of 45 minutes. After stirring the mixture vigorously for a further 1 hour, 2.95 g (0.015 moles) of 3-mercaptopropyltrimethoxysilane are added. After a further 30 minutes of stirring, the emulsion is cooled to 40° C. and its pH is adjusted to a value between 4 and 5 by the addition of 15 g of a 10% acetic acid solution.

The emulsion so prepared which is referred to in the following as emulsion A, contains 25 weight percent of an organopolysiloxane of formula (aa), in which the $R^1$ radicals are methyl radicals, of which, however, 0.33 mole percent are replaced by 3-mercaptopropyl radicals and n=1.993.

Furthermore, an emulsion referred to herein as emulsion B, composed of 25 weight percent of polymethylhydrogensiloxane of the formula

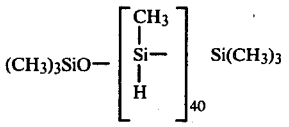

is prepared with the help of 4 weight percent of an alkylaryltrimethylammonium chloride as the emulsifier and 71 weight percent of water in the customary manner, that is, with vigorous stirring.

By mixing the two components described above, the inventive storage-stable aqueous preparations listed below are obtained:

| No. | Weight Percent of Emulsion A | Weight Percent of Emulsion B |
|---|---|---|
| 1 a | 97.5 | 2.5 |
| 1 b | 95.0 | 5.0 |
| 1 c | 92.5 | 7.5 |
| 1 d | 90.0 | 10.0 |
| 1 e | 80.0 | 20.0 |
| | not of the invention | |
| 1 f | 100.0 | 0 |
| | not of the invention | |
| 1 g | 0 | 100.0 |

The shrinkproofness and antifelting effects achieved with these preparations are described in the following application examples.

EXAMPLE 2

To an emulsifier solution the same as that of Example 1 and heated to 95° C., 146 g (0.492 moles) of octamethylcyclotetrasiloxane are added dropwise with vigorous stirring. After continuing the stirring for 1 additional hour and an interval of 30 minutes, 27 g (0.0975 moles) of methyldodecyldiethoxy silane and 2.7 g (0.0138 moles) of 3-mercaptopropyltrimethoxysilane are added dropwise and vigorous stirring once again is continued for a further 30 minutes. After cooling to 40° C., the potassium hydroxide which is contained in the emulsion, is neutralized by the addition of 15 g of a 10% acetic acid solution and, at the same time, the pH is adjusted to a value of 4 to 5.

The finely particulate aqueous emulsion contains organopolysiloxane units corresponding to formula (aa), in which the $R^1$ radicals are methyl radicals, of which, however, 2.36 mole percent are replaced by $C_{12}H_{25}$ radicals and 0.33 mole percent by 3-mercaptopropyl radicals, and n=1.993.

From 90 weight percent of this emulsion and 10 weight percent of emulsion B from Example 1, a storage-stable, aqueous preparation in accordance with the invention is once again obtained simply by mixing.

EXAMPLE 3

(comparison example, not in accordance with the invention, corresponding to Example 2 of German Offenlegungsschrift No. 2,912,431)

To a solution of 5 parts by weight of hexadecyltrimethylammonium chloride in 67 parts by weight of water, a mixture is added which consists of 0.45 parts by weight of 3-mercaptopropyltrimethoxysilane and 25 parts by weight of octamethylcyclotetrasiloxane and which has been prepared in a separate vessel. After adjusting the pH of the mixture obtained to a value of 13 with potassium hydroxide, the mixture is passed twice through a colloid mill with an opening of 254μ.

The mixture is then heated for 3 hours at 80° C., cooled to 40° C. and allowed to stand for 10 hours, after which it is neutralized with hydrochloric acid. A turbid milky liquid is obtained.

EXAMPLE 4

(comparison example, not of the invention, corresponding to Example 2 of German Offenlegungsschrift No. 2,725,714)

A siloxane copolymer is prepared by heating together 7.5 parts by weight of $CH_3(CH_3O)_2Si(CH_2)_3NHCH_2CH_2NH_2$ and 1000 parts by weight of a polydimethylsiloxane with a hydroxyl group at each terminal silicon atom and a viscosity of about 4500 cSt at 25° C. Heating is carried out for 2 hours at 150° C. under nitrogen with vigorous stirring. The copolymer formed is a clear fluid with a viscosity of about 6000 $mm^2$/sec at 25° C.

A copolymer (33.33 parts by weight), prepared as described above, is added to a mixture of 63.33 parts by weight of water, 1.42 parts by weight of Ethomeen S12, 0.24 parts by weight of Ethomeen S15 and 1.67 parts by weight of Tergitol TMN.6. The mixture is stirred rapidly to produce a siloxane-in-water emulsion (Emulsion C).

By the same procedure, an aqueous emulsion (Emulsion D) is prepared from 33.33 parts by weight of a polymethylhydrogen siloxane having terminal trimethylsiloxy groups and a viscosity of Ethomeen S12, 0.28 parts by weight of Ethomeen S15 and 1.67 parts by weight of Tergitol TMN.6 as emulsifiers. The amount of water used is 64.11 parts by weight and the pH of the emulsion is adjusted to a value of about 4.0 by the addition of acetic acid.

APPLICATION EXAMPLE 5

A material, knitted from a fine wool, is treated on a padder with the preparations described in Examples 1 to 4 but further diluted in such a way, that a solids add-on of 2% results after the impregnated knitted material is dried for 5 minutes at 140° C.

APPLICATION EXAMPLE 6

The fine woolen material is finished with preparation (c) of Example 1 by padding as well as by the exhaustion process in a laboratory winch dyeing machine. For this purpose, a knitted strip, weighing 200 g, is treated in a liquor consisting of 1.5 l water, 8 g of emulsion according to preparation 1 (c) and 8 g $Na_2S_2O_5$.

After the temperature of the liquor is increased from 20° C. to 45° C., the active ingredients are exhausted up to 100% onto the wool within 15 to 20 minutes. After drying at 140° C. for a period of 5 minutes, the organopolysiloxane add-on is 2% based on the amount of fine woolen material used.

APPLICATION EXAMPLE 7

Water (360 parts by weight) in a large beaker is mixed consecutively with stirring with 2.7 parts by weight of emulsion C, 0.135 parts by weight of emulsion D from comparison Example 4, and 0.505 parts by weight of magnesium sulfate. The pH of the mixture obtained is adjusted to a value of about 5.5 by the addition of acetic acid. A piece of fine woolen material with the dimensions of 30×40 cm is then dipped into the liquid. The temperature of the liquid is increased slowly to 40° C. and the woolen material is moved around. In about 35 minutes, the liquid becomes clear, indicating deposition on the material. The material is then taken out, dried for about 6 minutes at 80° C. and exposed for 3 days to the ambient atmosphere (60% relative humidity, 20° C.).

APPLICATION EXAMPLE 8

Preparation (c) from Example 1, as well as a mixture of 92.5 weight percent of emulsion C and 7.5 weigh percent of emulsion D from comparison Example 4 are used 8 days after mixing for the treatment of the knitted fine woolen material. In this case also, the further diluted emulsions are padded onto the knitted woolen material in such a manner that, after drying by the procedure already described, the add-on of active ingredient is 2%.

Determination of Shrinkproofness

The shrinkproofness of the samples, treated in application Examples 1 to 8, is determined according to the recommendations of the International Wool Secretariat, Test Method 185. In this test method, samples of material are subjected to laundering for 3 hours in an International Cubex Machine. From the dimensions of the material before and after laundering, the area felting shrinkage can be determined from the formula $$AFS = \% L + \% W - \frac{\% L \times \% W}{100}$$

% L = percentage of shrinkage in length,
% W = percentage of shrinkage in width.
The following values were obtained:

| Application Example | Preparation according to Example | % AFS |
|---|---|---|
| 5 | 1 a | 9.5 |
| | 1 b | 5.5 |
| | 1 c | 0.5 |
| | 1 d | 2.5 |
| | 1 e | 11.0 |
| | 1 f not of the invention | 21.0 |
| | 1 g not of the invention | 37.0 |
| | 2 | 3.0 |
| | 3 Comparison Example | 31.0 |
| | 4 Comparison Example | 12.0 |
| 6 | 1 c | 1.0 |
| 7 | 4 Comparison Example | 17.0 |
| 8 | 1 c | 1.0 |
| | 4 Comparison Example | 27.0 |
| | Untreated fine woolen material | 45.0 |

In contrast to the materials treated with the compositions of the present invention, the sample which has not been finished, revealed a strongly felted surface. In addition, the hand of the treated samples is significantly softer even after laundering than the hand of the untreated material before laundering. Moreover, in comparison with the sample which has been finished in application Example 5 with the preparation from Comparison Example 4, the inventively treated samples show no yellowing.

We claim:

1. A composition for shrinkproofing wool comprising (a) from about 1 to 50 weight percent of organopolysiloxanes composed of (aa) 80 to 99.8 weight percent of units of the formula $$R_n^1SiO_{\frac{4-n}{2}}$$

and (ab) 0.2 to 20 weight percent of units of the formula $$R_m^2SiO_{\frac{4-m}{2}}$$

in the form of copolymers or in the form of mixtures in each case of siloxanes with units of formula (aa) and siloxanes with units of formula (ab), wherein the $R^1$ radicals consist of mercaptoalkyl or mercaptoaryl radicals to the extent of 0.03 to 3 moles percent and the $R^2$ radicals of hydrogen atoms to the extent of 5 to 50 mole percent, the remaining portion of $R^1$ and $R^2$ radicals being methyl radicals of which up to 10 mole percent may be replaced by longer-chain alkyl, aryl, or hydrogen radicals, n has a value of 1.8 to 2.0 and m has a value of 2.0 to 2.5, and (b) about 50 to 99 weight percent of water.

2. The composition of claim 1 wherein the organopolysiloxanes in which the $R^1$ radical consists of mercaptoalkyl or mercaptoaryl radicals is present in an amount of 0.1 to 0.5 mole percent and the remaining portion of the $R^1$ radicals are methyl radicals.

3. The composition of claim 1 or 2 wherein the $R^2$ radicals consist of hydrogen atoms in an amount of 36 to 48 mole percent, m has a value of 2.2 to 2.03 and the remaining portion of $R^2$ radicals are methyl radicals.

4. The composition of claim 1 or 2 wherein the $R^2$ radicals consist of hydrogen atoms in an amount of 36 to 48 mole percent, m has a value of 2.2 to 2.03 and the remaining portion of $R^2$ radicals are methyl radicals and the siloxanes of the structure unit (ab) have the formula

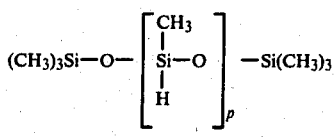

in which p has a value from 3 to 50.

5. The composition of claim 1 or 2 wherein n has a value of from 1.990 to 1.998.

6. The composition of claim 1 or 2 wherein the mercaptoalkyl radicals are 3-mercaptopropyl radicals.

7. The composition of claim 1 or 2 wherein the organopolysiloxanes of structure unit (aa) contain terminally linked mercaptoalkyl or mercaptoaryl radicals.

8. In a method for shrinkproofing wool wherein the wool is treated with a shrinkproofing composition in the form of a solution or emulsion, the improvement which comprises said composition being (a) from about 1 to 50 weight percent of organopolysiloxanes composed of (aa) 80 to 99.8 weight percent of units of the formula $$R_n^1SiO_{\frac{4-n}{2}}$$

and (ab) 0.2 to 20 weight percent of units of the formula $$R_m^2SiO_{\frac{4-m}{2}}$$

in the form of copolymers or in the form of mixtures in each case of siloxanes with units of formula (aa) and siloxanes with units of formula (ab), wherein the $R^1$ radicals consist of mercaptoalkyl or mercaptoaryl radicals to the extent of 0.03 to 3 mole percent and the $R^2$ radicals of hydrogen atoms to the extent of 5 to 50 mole percent, the remaining portion of $R^1$ and $R^2$ radicals being methyl radicals of which up to 10 mole percent may be replaced by longer-chain alkyl, aryl, or hydrogen radicals, n has a value of 1.8 to 2.0 and m has a value of 2.0 to 2.5, and (b) about 50 to 99 weight percent of water.

9. The method of claim 8 wherein the organopolysiloxanes in which the $R^1$ radical consists of mercaptoalkyl or mercaptoaryl radicals is present in an amount of 0.1 to 0.5 mole percent and the remaining portion of the $R^1$ radicals are methyl radicals.

10. The method of claim 8 or 9 wherein the $R^2$ radicals consist of hydrogen atoms in an amount of 36 to 48 mole percent, m has a value of 2.2 to 2.03 and the remaining portion of $R^2$ radicals are methyl radicals.

11. The method of claim 8 or 9 wherein the $R^2$ radicals consist of hydrogen atoms in an amount of 36 to 48 mole percent, m has a value of 2.2 to 2.03 and the remaining portion of $R^2$ radicals are methyl radicals and the siloxanes of the structure unit (ab) have the formula

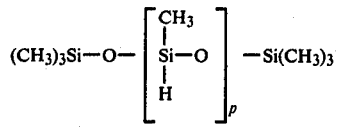

in which p has a value from 3 to 50.

12. The method of claim 8 or 9 wherein n has a value of from1.990 to 1.998.

13. The method of claim 8 or 9 wherein the mercaptoalkyl radicals are 3-mercaptopropyl radicals.

14. The method of claim 8 or 9 wherein the organopolysiloxanes of structure unit (aa) contain terminally linked mercaptoalkyl or mercaptoaryl radicals.

15. Wool treated by the method of claim 8 or 9.

* * * * *